US006240574B1

(12) United States Patent
Mayyak

(10) Patent No.: US 6,240,574 B1
(45) Date of Patent: Jun. 5, 2001

(54) METHOD AND ARRANGEMENT FOR AUTOMATICALLY RAISING A TOILET SEAT

(76) Inventor: Nikolay Mayyak, 9649 S. Silverberry Cir., Littleton, CO (US) 80129

( * ) Notice: Subject to any disclaimer, the term of this patent is extended or adjusted under 35 U.S.C. 154(b) by 0 days.

(21) Appl. No.: 09/684,086

(22) Filed: Oct. 10, 2000

(51) Int. Cl.[7] ..... A46K 13/10
(52) U.S. Cl. ..... 4/246.1; 4/241
(58) Field of Search ..... 4/241, 246.1, 246.3–246.5

(56) References Cited

U.S. PATENT DOCUMENTS 5,437,063 * 8/1995 Cotham ..... 4/241
5,754,985 * 5/1998 Dias ..... 4/241
5,781,938 * 7/1998 Anderson ..... 4/241

* cited by examiner

*Primary Examiner*—Charles R. Eloshway

(57) ABSTRACT

An apparatus for automatically raising a toilet seat when the toilet is flushed includes a toilet tank pivotally mounted on the bowl and a spring connected between the toilet tank and seat. A weight is attached to the spring. When the toilet seat is manually lowered, the spring flips to the upward position and holds the seat down. When the toilet is flushed, the decreasing water level in the tank changes the center of gravity of the tank and causes it to pivot, thereby flexing the spring in the opposite direction, with the aid of an attached counterweight, and raising the seat.

3 Claims, 1 Drawing Sheet

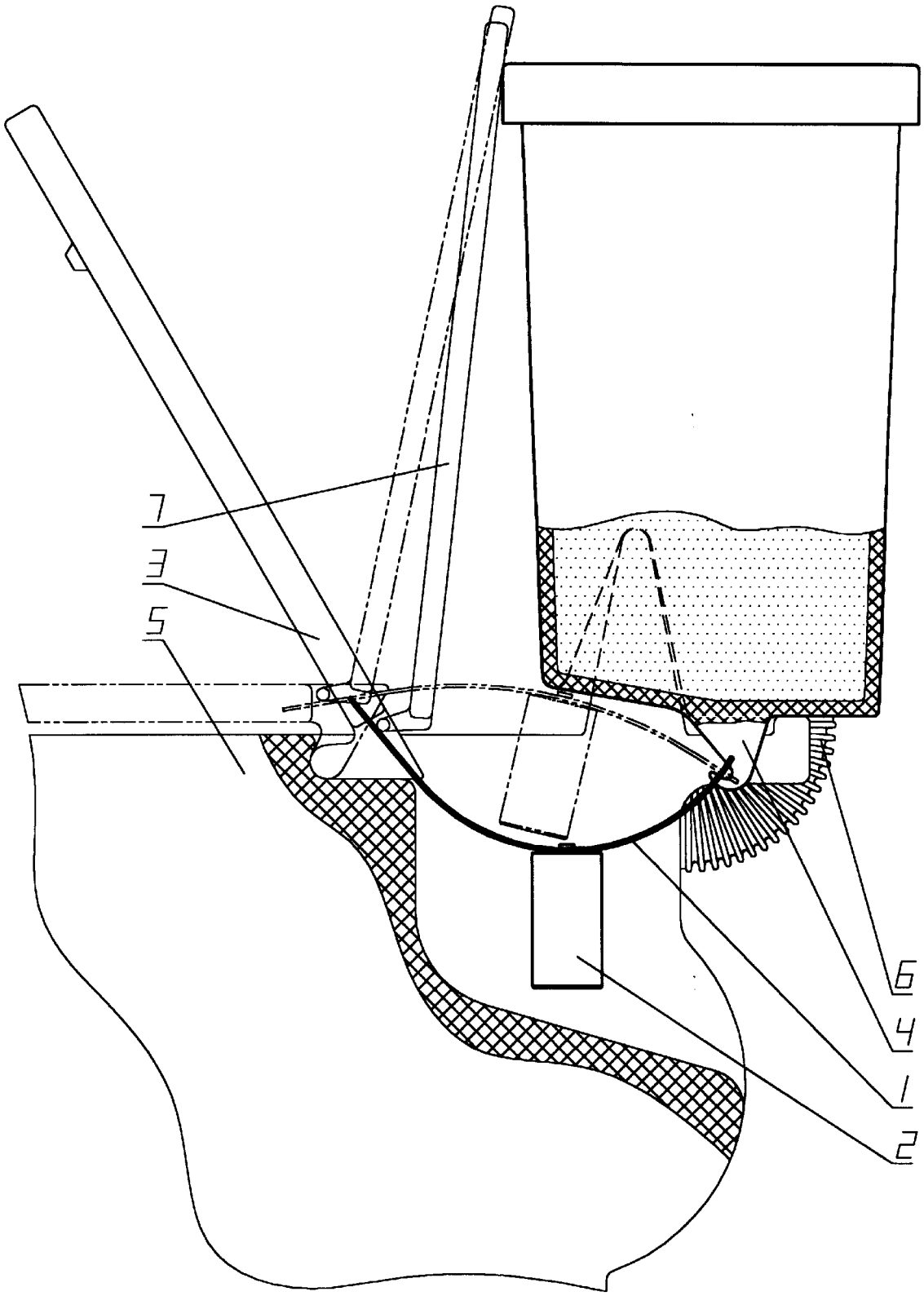
7
3
5
6
4
1
2

METHOD AND ARRANGEMENT FOR AUTOMATICALLY RAISING A TOILET SEAT

FEDERALLY SPONSORED RESEARCH OR DEVELOPMENT

Not Applicable

REFERENCE TO A MICROFICHE APPENDIX

Not Applicable

BACKGROUND OF THE INVENTION

The bathroom users experience three major problems with the toilet seats. The first problem is the seat can get wet. I found and studied quite a bit of the utility patents on toilet seat lifters. The U.S. patent numbers are: U.S. Pat. Nos. 4,030,146, 4,103,371, 4,150,446, 4,426,743, 4,470,161, 4,534,073, 4,578,830, 4,649,576, 4,975,988, 5,103,506, 5,237,708, 5,448,782, 5,488,743, 6,081,936. Those lifters supposedly solve problem of lifting and lowering the toilet seat without touching by the person using the bathroom, with the purpose of preventing a toilet seat from being wet by urine. The problem is important, however you do not see those lifters in the stores. The lifters are too complicated, have too many parts and have expensive components. They would cost too much to produce and create an "industrial" look in the bathroom. They also are not easy to install, maintain or clean. On the other hand, the bathroom users, especially children, will not always step on those pedals, trigger sensor pads and push those buttons.

The second problem with the conventional toilet seat is: the seat can be in two positions, either up or down. In some families males are responsible for leaving a toilet seat in the down position after using the bathroom. If he forgets to put the seat down, it might cause night accidents, as females, without turning the light on, sit on the toilet bowl instead of toilet seat. If a toilet seat has the ability to automatically come to the only position after the person uses the bathroom, that problem of accidents, as described, would be eliminated. I found the U.S. Pat. Nos. 4,910,810, 5,138,724 and 5,435,017, which offer the solution to the problem. These lifters, after a delay, automatically raise the seat from the horizontal position after the seat was released. The U.S. Pat. Nos. 5,020,165, 5,437,063, 5,754,985 offer to raise the seat using the toilet flushing. Again, those lifters have many weak points.

The third problem with the conventional toilet seat is: the areas around the hinges for the toilet seat cannot easily or thoroughly be cleaned where it attaches to the toilet bowl. The existing projects on the toilet seat lifters do not offer the solution, they make cleanliness problem more complicated.

SUMMARY OF THE INVENTION

Method and arrangement for automatically raising a toilet seat. The toilet seat lifter contains virtually two very simple and technological parts. This solves the problems as described in the BACKGROUND OF THE INVENTION section. A spring is attached to the rear of a seat above the pivot point and to the bottom of a water tank. The water tank has a pivot point located above the spring, in front of the water center of gravity, so the spring can be compressed more or less depending on the amount of water in the tank. In order to deliver the water from the water tank to the toilet and to allow the tank to be pivoted, the water tank is connected to the toilet with a flexible hose. The second part of the toilet seat lifter is the weight mounted on the spring. The weight allows the spring to be flipped from the up position (the toilet seat is down) to the down position as the amount of water in the tank decreases during toilet flushing and to hold the toilet seat in the up position.

The toilet seat lifter provides the possibility to use a recess in a toilet bowl to hold the seat instead of hinges. That allows a toilet seat and a toilet lid to be easily removed for cleaning.

DESCRIPTION OF THE DRAWING

The drawing shows the side view of the toilet seat lifter. Solid lines represent the lifter as the seat is in upward position. Phantom lines represent the lifter as the seat is in downward position.

DETAILED DESCRIPTION OF THE INVENTION

Method and arrangement for automatically raising a toilet seat. The new toilet seat lifter offers the solution to the three major problems which bathroom users experience with the conventional toilet seat. The new lifter prevents the seat from being wet, automatically raises the seat to the only position after toilet flushing, and allows the seat to be easily removed for cleaning or washing. Unlike the other toilet seat lifters, this new lifter is very simple and contains only two, low cost, technological parts. The new lifter requires no maintenance and can be easily installed and removed. The new lifter can be used with the redesigned toilet bowl and water tank. The modification is slight if the manufacturer decides to go with two lifters on the sides of a toilet. I would go with one lifter located at or close to the center of toilet. The cost of modification and transition to a new production environment would be insignificant compared to mass production profits.

The lifter comprises of the spring 1 and the weight 2 mounted on the spring 1. The spring 1 is secured to the rear of the seat 3 above a toilet seat's pivot point and to the bottom of the water tank 4. The water tank 4 is pivotally mounted on a toilet bowl 5 so that the water tank's pivot point is located above spring 1 and in front of the water center of gravity. The water tank 4 is connected to the toilet bowl 5 with a flexible hose 6.

The toilets seat 3 remains in the up position at all times unless there is a need to lower it. The spring 1 and weight 2 are in the down position holding the toilet seat 3. The spring 1 is compressed from the turning moment applied from the water tank 4. The turning moment is at a maximum when the water tank 4 is full of water.

When the toilet seat 3 is manually lowered, the spring 1 flips into up position and remains there in the compressed condition holding the seat 3 down. The weight 2 is not capable of overcoming the maximum turning moment from the water tank 4 and not capable of flipping the spring 1 down. During toilet flushing the amount of water in the tank 4 decreases, the turning moment drastically reduces as well, the spring 1 flexes, pivoting the water tank 4, and the weight 2 flips the spring 1 down. The toilet seat 3 starts raising. The seat 3 gets in the up position when the water amount in the tank 4 increases. The toilet seats 3 gravity, inertia forces and the spring 1 will prevent the water tank 4 from slamming on the toilet bowl 5.

No matter what position the toilet seat 3 has, the spring 1 always pushes the seat 3 in the direction away from the water tank 4, which allows a recess in the toilet bowl 5 to be used for toilet seat 3 mounting. As a result, the seat 3 and the lid 7 mount can be easily removed from the toilet bowl 5 for washing. The seat 3 should be moved towards the tank 4 and raised to be cleared and moved out.

There are many ways to secure the spring to the toilet seat. I would suggest securing the spring during the toilet seat molding/extrusion process. No fasteners are required. The other end of the spring should be pivotally secured to the bottom of a water tank. Again, there are many ways to provide it. My suggestion is to make a slot at the end of the spring and a hole next to the slot. The water tank should have a hook on the bottom of it. The slot would engage onto the body of the hook to secure the spring in the correct position. As the toilet seat raises, the hook engages into the spring hole and holds the spring. To reduce friction between the spring and the hook it is offered to round the edges of the spring slot and hole by forming a lip around the hole and slot during the spring making process. Another hole with a lip around it should be formed also for mounting the weight. The weight can have a short pin extending out of it. To mount the weight on the spring, the pin should be inserted in the hole and crimped. Again, no fasteners are required.

To provide acceptable stress in the zone where the water tank is mounted on the toilet, it is necessary to have a big enough contact area between the water tank and the toilet.

I claim:

1. In combination with a toilet including a toilet bowl, a water tank, a toilet seat pivotally connected to the toilet bowl, and a toilet lid, an arrangement for automatically raising the toilet seat, the arrangement comprising:

a toilet seat lifter defined by a spring and a weight mounted on the spring, a forward portion of the spring being mounted to a rear portion of the toilet seat above the pivotal connection between the toilet seat and the bowl, a back portion of the spring being mounted to a bottom of the water tank;

the water tank being pivotally mounted on the bowl, the pivot point being located above the connection of the spring to the water tank and forward of the center of gravity of the tank when filled with water to flushing capacity; and a flexible hose connecting the water tank and the toilet bowl allowing water to flow from the tank to the bowl for flushing thereof.

2. The arrangement according to claim 1, further comprising a toilet lid pivotally mounted on the toilet seat.

3. The arrangement of claim 1, wherein the bowl has a recess in a top rim surface that accommodates a rear portion of the toilet seat during pivoting of the seat from a lowered to a raised position.

* * * * *